US012599275B2

(12) United States Patent
Mian et al.

(10) Patent No.: US 12,599,275 B2
(45) Date of Patent: Apr. 14, 2026

(54) VACUUM CLEANER APPARATUS, VACUUM CLEANER UNIT, AND METHOD OF OPERATING A VACUUM CLEANER APPARATUS

(71) Applicant: Aktiebolaget Electrolux, Stockholm (SE)

(72) Inventors: Peter Mian, Stockholm (SE); Christoffer Sörmark, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 279 days.

(21) Appl. No.: 18/027,791

(22) PCT Filed: Oct. 1, 2020

(86) PCT No.: PCT/EP2020/077538

§ 371 (c)(1),
(2) Date: Mar. 22, 2023

(87) PCT Pub. No.: WO2022/069049

PCT Pub. Date: Apr. 7, 2022

(65) Prior Publication Data

US 2023/0355047 A1 Nov. 9, 2023

(51) Int. Cl.
*A47L 5/22* (2006.01)
*A47L 5/24* (2006.01)
(Continued)

(52) U.S. Cl.
CPC ..... *A47L 5/225* (2013.01); *A47L 5/24* (2013.01); *A47L 9/102* (2013.01); *A47L 9/2836* (2013.01); *A47L 9/2884* (2013.01)

(58) Field of Classification Search
None
See application file for complete search history.

(56) References Cited

U.S. PATENT DOCUMENTS 4,960,446 A * 10/1990 Werner ..... A47L 9/1409 15/352
5,819,364 A * 10/1998 Sham ..... A47L 5/24 15/329

(Continued)

FOREIGN PATENT DOCUMENTS

CN 1994211 7/2007
CN 108903790 A * 11/2018 ..... A47L 5/24

(Continued)

OTHER PUBLICATIONS

Total Tools, Apr. 17, 2017 "Brushless vs Brushed Tools" https://www.totaltools.com.au/blog/post/brushless-vs-brushed-motors (Year: 2017).*

(Continued)

*Primary Examiner* — David S Posigian
*Assistant Examiner* — Dana Lee Poon
(74) *Attorney, Agent, or Firm* — Chrisman Gallo Tochtrop LLC

(57) ABSTRACT

A vacuum cleaner apparatus having a first vacuum cleaner unit and a second vacuum cleaner unit. The apparatus includes a first motor/fan unit arranged in the first vacuum cleaner unit and a second motor/fan unit and a second dust separation unit arranged in the second vacuum cleaner unit. The apparatus further includes a connection interface for removably connecting a suction inlet of the second vacuum cleaner unit to an airflow path of the first vacuum cleaner unit. The apparatus further includes a control arrangement capable of operating the apparatus in a cooperative cleaning mode in which the first and second motor/fan units are operated simultaneously. A method of operating a vacuum cleaner apparatus is also provided.

21 Claims, 5 Drawing Sheets

(51) Int. Cl.
*A47L 9/10* (2006.01)
*A47L 9/28* (2006.01)

(56) References Cited

U.S. PATENT DOCUMENTS

| | | | | |
|---|---|---|---|---|
| 6,122,796 | A * | 9/2000 | Downham | A47L 5/362 15/328 |
| 8,225,456 | B2 * | 7/2012 | Hakan | A47L 9/106 15/329 |
| 2007/0157420 | A1 * | 7/2007 | Lee | A47L 5/28 15/328 |
| 2008/0040883 | A1 * | 2/2008 | Beskow | A47L 9/20 15/329 |
| 2014/0366306 | A1 * | 12/2014 | Clothier | A47L 9/2894 15/377 |
| 2016/0106285 | A1 * | 4/2016 | Jenson | A47L 5/28 15/329 |

FOREIGN PATENT DOCUMENTS

| | | | |
|---|---|---|---|
| EP | 2848173 | A1 | 3/2015 |
| JP | 6464613 | A | 3/1989 |

OTHER PUBLICATIONS

International Search Report and Written Opinion for International Application No. PCT/EP2020/077538, dated Jun. 14, 2021, 8 pages.
Chinese Office Action dated Mar. 30, 2025 of corresponding Chinese Patent Application No. 202080105475.0.

* cited by examiner

VACUUM CLEANER APPARATUS, VACUUM CLEANER UNIT, AND METHOD OF OPERATING A VACUUM CLEANER APPARATUS

This application is a U.S. National Phase application of PCT International Application No. PCT/EP2020/077538, filed Oct. 1, 2020, which is incorporated by reference herein.

TECHNICAL FIELD

The present disclosure relates to a vacuum cleaner apparatus. The present disclosure further relates to a vacuum cleaner unit and a method of operating a vacuum cleaner apparatus.

BACKGROUND

A vacuum cleaner is an apparatus that uses a motor/fan unit to create a partial vacuum in order to obtain an air flow for sucking up dust and dirt from surfaces, such as floors, carpets, furniture, curtains, and the like. The motor/fan unit usually comprises a centrifugal fan and an electric motor configured to power, i.e. rotate, the centrifugal fan.

In general, some problems and requirements exist when designing vacuum cleaners. One example is cleaning efficiency. Users of vacuum cleaners expect a high cleaning efficiency to achieve a good cleaning result with little effort. The cleaning efficiency partly depends on the airflow rate, an in turn, the airflow rate depends on the magnitude of the partial vacuum created by the motor/fan unit. In many vacuum cleaners, the power of the motor/fan unit can be regulated. Thereby, a user can reduce the power when wanting to clean sensitive and soft surfaces, such as curtains and carpets, and can increase the power when wanting to clean harder surfaces, such as floor surfaces.

Another important requirement of vacuum cleaners is energy efficiency. In a vacuum cleaner, the energy efficiency can be defined as the ratio between the useful output in the form of airflow and the input of electrical energy. A problem associated with vacuum cleaners is that the energy efficiency of the vacuum cleaner drops significantly at higher power levels of the motor/fan unit. Likewise, the energy efficiency of the vacuum cleaner drops significantly at lower power levels of the motor/fan unit. That is, when the motor/fan unit of a vacuum cleaner is operated at higher power levels, as well as at lower power levels, the ratio between the useful output in the form of airflow and the input of electrical energy drops significantly. In other words, many motor/fan units have a narrow operational range in which the vacuum cleaner can be operating in an efficient manner.

Other important requirements of vacuum cleaners are flexibility and usability. Many vacuum cleaners can be bulky and can be difficult to use when cleaning confined spaces and objects at higher places, such as curtains, cabinets, and the like.

Furthermore, generally, on today's consumer market, it is an advantage if products, such as vacuum cleaners and associated components, systems, and arrangements, have conditions and/or characteristics suitable for being manufactured and assembled in a cost-efficient manner.

SUMMARY

It is an object of the present invention to overcome, or at least alleviate, at least some of the above-mentioned problems and drawbacks.

According to a first aspect of the invention, the object is achieved by a vacuum cleaner apparatus comprising a first vacuum cleaner unit and a second vacuum cleaner unit. The apparatus comprises a first motor/fan unit and a first dust separation unit arranged in the first vacuum cleaner unit. The first motor/fan unit is configured to generate an airflow through an airflow path of the first vacuum cleaner unit to the first dust separation unit. The apparatus comprises a second motor/fan unit and a second dust separation unit arranged in the second vacuum cleaner unit. The second motor/fan unit is configured to generate an airflow from a suction inlet of the second vacuum cleaner unit to the second dust separation unit. The apparatus comprises a connection interface configured to removably connect the suction inlet of the second vacuum cleaner unit to the airflow path of the first vacuum cleaner unit. The apparatus comprises a control arrangement capable of operating the apparatus in a cooperative cleaning mode in which the first and second motor/fan units are operated simultaneously.

Since the apparatus comprises the connection interface configured to removably connect the suction inlet of the second vacuum cleaner unit to the airflow path of the first vacuum cleaner unit and the control arrangement capable of operating the first and second motor/fan units simultaneously, a vacuum cleaner apparatus is provided having conditions for a significantly widened operational range in which the vacuum cleaner apparatus can be operated in an efficient manner. This is because the first and second motor/fan units can operate in a parallel manner when the apparatus is operating in the cooperative cleaning mode. That is, in the cooperative cleaning mode, the first and second motor/fan units can operate in a parallel manner in which the partial vacuum created by the respective first and second motor/fan units together causes an airflow at a suction inlet of the first vacuum cleaner in a cooperative manner.

Moreover, dust entering the suction inlet of the first vacuum cleaner can be collected in the first dust separation unit as well as in the second dust separation unit which can increase the total dust accumulating capacity of the apparatus.

As a further result of these features, a vacuum cleaner apparatus is provided having conditions for generating high airflow rates at a suction inlet of the first vacuum cleaner unit in an energy efficient manner. In other words, a vacuum cleaner apparatus is provided having conditions for providing high cleaning efficiency while consuming a low amount of electrical energy.

In addition, a more versatile and flexible vacuum cleaner apparatus is provided having conditions for varying the power in a wider range so as to obtain a wanted airflow rate at minimum energy consumption. Furthermore, conditions are provided for utilizing smaller motor/fan units in the apparatus and still obtain a high airflow rate when operating the apparatus in the cooperative cleaning mode.

Accordingly, a vacuum cleaner apparatus is provided overcoming, or at least alleviating, at least some of the above-mentioned problems and drawbacks. As a result, the above-mentioned object is achieved.

Optionally, the second vacuum cleaner unit is operable as a vacuum cleaner in isolation of the first vacuum cleaner unit. Thereby, a more versatile and flexible vacuum cleaner apparatus is provided in which the second vacuum cleaner unit can be removed from the first vacuum cleaner unit to be used as a vacuum cleaner in isolation of the first vacuum cleaner unit.

Optionally, the connection interface further comprises a holding arrangement configured to hold the second vacuum cleaner unit relative to the first vacuum cleaner unit when the suction inlet of the second vacuum cleaner unit is connected to the airflow path of the first vacuum cleaner unit. Thereby, a user-friendly vacuum cleaner apparatus is provided in which the second vacuum cleaner unit can be held relative to the first vacuum cleaner unit during use of the apparatus as well as during storage of the apparatus.

Optionally, the second vacuum cleaner unit comprises a battery unit configured to power the second motor/fan unit, at least when the suction inlet of the second vacuum cleaner unit is removed from the airflow path of the first vacuum cleaner unit. Thereby, a user-friendly vacuum cleaner apparatus is provided where the second vacuum cleaner unit can be operated in isolation of the first vacuum cleaner unit without using a cord connected to a socket.

Optionally, the connection interface comprises electrical connections configured to transfer electricity between the first and second vacuum cleaner units. Thereby, the vacuum cleaner apparatus provides conditions for a transfer of energy and/or signals between the first and second vacuum cleaner units.

Optionally, the battery unit of the second vacuum cleaner unit is rechargeable and is configured to be charged using electricity supplied via the electrical connections. Thereby, a user-friendly vacuum cleaner apparatus is provided where the battery unit of the second vacuum cleaner can be charged simply by connecting the second vacuum cleaner unit to the connection interface.

Optionally, the second motor/fan unit is differently configured than the first motor/fan unit. According to these embodiments, the second motor/fan unit may be differently configured than the first motor/fan unit regarding structural aspects and/or regarding efficient working point, i.e. the operational point at which the motor/fan unit operates most efficiently. The structural aspects may include one or more of type of motor, size of motor, type of fan, and size of fan. Since according to these embodiments, the second motor/fan unit is differently configured than the first motor/fan unit, and due to the parallel arrangement of the motor/fan units, a vacuum cleaner apparatus is provided having conditions for a further widened operational range in which the vacuum cleaner apparatus can be operated in an efficient manner.

Optionally, the second motor/fan unit comprises a fan and a brushless motor configured to power the fan. Thereby, a vacuum cleaner apparatus can be provided having conditions for a further widened operational range in which the vacuum cleaner apparatus can be operated in an efficient manner. This is because a motor/fan unit comprising a brushless motor usually has a high ability to quickly generate high vacuum levels.

Optionally, the first motor/fan unit comprises a fan and a brushed motor configured to power the fan. According to these embodiments, the brushed motor may be a so called canister motor. By combining a brushed motor and a brushless motor, an even further widened operational range can be obtained in which the vacuum cleaner apparatus can be operated in an efficient manner. This is because the brushed motor usually has a higher ability to generate high airflow rates whereas the brushless motor usually has a higher ability to quickly generate high vacuum levels.

Optionally, the second vacuum cleaner unit is smaller in size than the first vacuum cleaner unit. Thereby, an even more versatile and flexible vacuum cleaner apparatus is provided, wherein the second vacuum cleaner for example can be used in isolation of the first vacuum cleaner unit when wanting to quickly clean an area, when wanting to clean confined spaces, and/or when wanting to clean objects at higher places, such as curtains, cabinets, and the like.

Optionally, the control arrangement comprises a first electronic control unit arranged in the second vacuum cleaner unit, and wherein the first electronic control unit is configured to control the power of the second motor/fan unit during operation of the second vacuum cleaner unit. Since the first electronic control unit is arranged in the second vacuum cleaner unit, a vacuum cleaner apparatus is provided in which the first electronic control unit can be utilized for controlling the second motor/fan unit when the second vacuum cleaner unit is used in isolation of the first vacuum cleaner unit.

Optionally, the first electronic control unit is configured to control the power of the first and second motor/fan units when the control arrangement is operating in the cooperative cleaning mode. Since the first electronic control unit is arranged in the second vacuum cleaner unit, a vacuum cleaner apparatus is provided in which the first electronic control unit can be utilized for controlling the second motor/fan unit when the second vacuum cleaner unit is used in isolation of the first vacuum cleaner unit and in which the first electronic control unit can be utilized for controlling the first and second motor/fan units when operating in the cooperative cleaning mode. In this manner, the need for an electronic control unit in the first vacuum cleaner unit is circumvented. As a further result thereof, a vacuum cleaner apparatus is provided having conditions and characteristics suitable for being manufactured and assembled in a cost-efficient manner.

Optionally, the control arrangement comprises a second electronic control unit arranged in the first vacuum cleaner unit, and wherein the second electronic control unit is configured to control the power of the first and second motor/fan units when the control arrangement is operating in the cooperative cleaning mode. Thereby, conditions are provided for a small sized and low weight second vacuum cleaner unit. This because the first electronic control unit in the second vacuum cleaner unit can be made less complex and smaller in size.

Optionally, the first vacuum cleaner unit is operable as a vacuum cleaner in isolation of the second vacuum cleaner unit, and wherein the second electronic control unit is configured to control the power of the first motor/fan unit when the second vacuum cleaner unit is removed from the first vacuum cleaner unit. Thereby, a still more versatile and flexible vacuum cleaner apparatus is provided in which the first vacuum cleaner unit can be used as a vacuum cleaner in isolation of the first vacuum cleaner unit.

Optionally, the connection interface comprises electrical connections configured operably connect the first and second electronic control units. Thereby, an apparatus is provided having conditions for operating in the cooperative cleaning mode in an efficient and reliable manner while conditions are provided for operating the first and second vacuum cleaner units in independent manners when the second vacuum cleaner unit is removed from the first vacuum cleaner unit.

Optionally, the connection interface comprises a closure member movably arranged between an open position, in which the closure member opens an aperture between the airflow path of the first vacuum cleaner unit and the suction inlet of the second vacuum cleaner unit, and a closed position in which the closure member closes the aperture. Thereby, the first vacuum cleaner unit has conditions for operating more efficiently in isolation of the second vacuum cleaner unit while allowing an airflow from the airflow path of the first vacuum cleaner unit to the suction inlet of the second vacuum cleaner unit during operation in the cooperative cleaning mode.

Optionally, the closure member is arranged on the first vacuum cleaner unit. Thereby, the first vacuum cleaner unit can operate more efficiently in isolation of the second vacuum cleaner unit while allowing an airflow from the airflow path of the first vacuum cleaner unit to the suction inlet of the second vacuum cleaner unit during operation in the cooperative cleaning mode.

Optionally, the closure member is configured to assume the closed position when the suction inlet is removed from the airflow path. Thereby, a more user-friendly vacuum cleaner apparatus is provided facilitating use of the first vacuum cleaner unit in isolation of the second vacuum cleaner.

Optionally, the control arrangement is capable of operating the apparatus in a non-cooperative cleaning mode in which only the first motor/fan unit is operated when the suction inlet is connected to the airflow path, and wherein the closure member is configured to assume the closed position when the apparatus is operating in the non-cooperative cleaning mode. Thereby, a reverse flow of air is avoided through the second vacuum cleaner unit when operating in the non-cooperative cleaning mode. Moreover, since the control arrangement is capable of operating the apparatus in the non-cooperative cleaning mode, an even more flexible and versatile vacuum cleaner apparatus is provided capable of operating in a still wider operational range.

Optionally, the connection interface comprises a sealing configured to seal an area around an aperture between the airflow path of the first vacuum cleaner unit and the suction inlet of the second vacuum cleaner unit when the suction inlet is connected to the airflow path. Thereby, leakage of ambient air is avoided into the suction inlet of the second vacuum cleaner unit when the suction inlet is connected to the airflow path. As a further result thereof, a high operational efficiency of the vacuum cleaner apparatus can be ensured.

Optionally, the second vacuum cleaner unit is a hand-held vacuum cleaner. Thereby, a versatile and flexible vacuum cleaner apparatus is provided, wherein the second vacuum cleaner for example may be used in isolation of the first vacuum cleaner unit when wanting to quickly clean an area, when wanting to clean confined spaces, and/or when wanting to clean objects at higher places, such as curtains, cabinets, and the like.

Optionally, the first vacuum cleaner unit is a stick-type vacuum cleaner. Thereby, a versatile and flexible vacuum cleaner apparatus is provided, wherein the first vacuum cleaner for example may be used in isolation of the second vacuum cleaner unit when wanting to clean larger areas, such as floor surfaces.

According to a second aspect of the invention, the object is achieved by a vacuum cleaner unit comprising a dust separation unit, an airflow path, and a motor/fan unit configured to generate an airflow through the airflow path to the first dust separation unit. The vacuum cleaner unit comprises a connection interface configured to removably connect a suction inlet of a second vacuum cleaner unit to the airflow path. The motor/fan unit is operably connected to the connection interface allowing for an operation in a cooperative cleaning mode in which the motor/fan unit of the vacuum cleaner unit and a motor/fan unit of the second vacuum cleaner unit are operated simultaneously.

Since the vacuum cleaner unit comprises the connection interface allowing for an operation in a cooperative cleaning mode in which the motor/fan unit of the vacuum cleaner unit and a motor/fan unit of the second vacuum cleaner unit are operated simultaneously, a vacuum cleaner unit is provided having conditions for a significantly widened operational range in which the vacuum cleaner apparatus can be operated in an efficient manner. This is because the first and second motor/fan units can operate in a parallel manner when operating in the cooperative cleaning mode. That is, in the cooperative cleaning mode, the first and second motor/fan units can operate in a parallel manner in which the partial vacuum created by the respective first and second motor/fan units together causes an airflow at a suction inlet of the first vacuum cleaner in a cooperative manner.

As a further result of these features, a vacuum cleaner unit is provided having conditions for generating high airflow rates at a suction inlet of the vacuum cleaner unit in an energy efficient manner. In other words, a vacuum cleaner unit is provided having conditions for providing high cleaning efficiency while consuming a low amount of electrical energy.

In addition, a more versatile and flexible vacuum cleaner unit is provided having conditions for varying the power in a wider range so as to obtain a wanted airflow rate at minimum energy consumption. Furthermore, conditions are provided for utilizing a smaller motor/fan unit in the vacuum cleaner unit and still obtain a high airflow rate when operating the apparatus in the cooperative cleaning mode.

Accordingly, a vacuum cleaner unit is provided overcoming, or at least alleviating, at least some of the above-mentioned problems and drawbacks. As a result, the above-mentioned object is achieved.

According to a third aspect of the invention, the object is achieved by a method of operating a vacuum cleaner apparatus comprising a first vacuum cleaner unit and a second vacuum cleaner unit. The apparatus comprises a first motor/fan unit and a first dust separation unit arranged in the first vacuum cleaner unit, wherein the first motor/fan unit is configured to generate an airflow through an airflow path of the first vacuum cleaner unit to the first dust separation unit. The apparatus further comprises a second motor/fan unit and a second dust separation unit arranged in the second vacuum cleaner unit, wherein the second motor/fan unit is configured to generate an airflow from a suction inlet of the second vacuum cleaner unit to the second dust separation unit. The apparatus further comprises a connection interface configured to removably connect the suction inlet of the second vacuum cleaner unit to the airflow path of the first vacuum cleaner unit. The method comprises the step of:

operating the motor/fan units of the first and second vacuum cleaner units simultaneously.

Since the method comprises the step of operating the motor/fan units of the first and second vacuum cleaner units simultaneously, the method provides conditions for significantly widening the operational range in which the vacuum cleaner apparatus can be operated in an efficient manner. This is because the first and second motor/fan units can operate in a parallel manner during the step of operating the motor/fan units of the first and second vacuum cleaner units simultaneously. That is, the first and second motor/fan units can operate in a parallel manner in which the partial vacuum created by the respective first and second motor/fan units together causes an airflow at a suction inlet of the first vacuum cleaner in a cooperative manner. Moreover, dust entering the suction inlet of the first vacuum cleaner can be collected in the first dust separation unit as well as in the second dust separation unit which can increase the total dust accumulating capacity of the apparatus.

As a further result of these features, a method is provided having conditions for generating high airflow rates at a suction inlet of the first vacuum cleaner unit in an energy efficient manner. In other words, a method is provided having conditions for providing high cleaning efficiency while consuming a low amount of electrical energy. Moreover, the method provides conditions for varying the power in a wider range so as to obtain a wanted airflow rate at minimum energy consumption. Furthermore, conditions are provided for utilizing smaller motor/fan units in the apparatus and still obtain a high airflow rate when operating the apparatus in the cooperative cleaning mode.

Accordingly, a method is provided overcoming, or at least alleviating, at least some of the above-mentioned problems and drawbacks. As a result, the above-mentioned object is achieved.

Optionally, the step of operating the motor/fan units of the first and second vacuum cleaner units simultaneously comprises the step of:

operating the first and second motor/fan units at different power levels.

Thereby, the method provides conditions for further widening the operational range in which the vacuum cleaner apparatus can be operated in an efficient manner in order to provide high cleaning efficiency while consuming a low amount of electrical energy.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
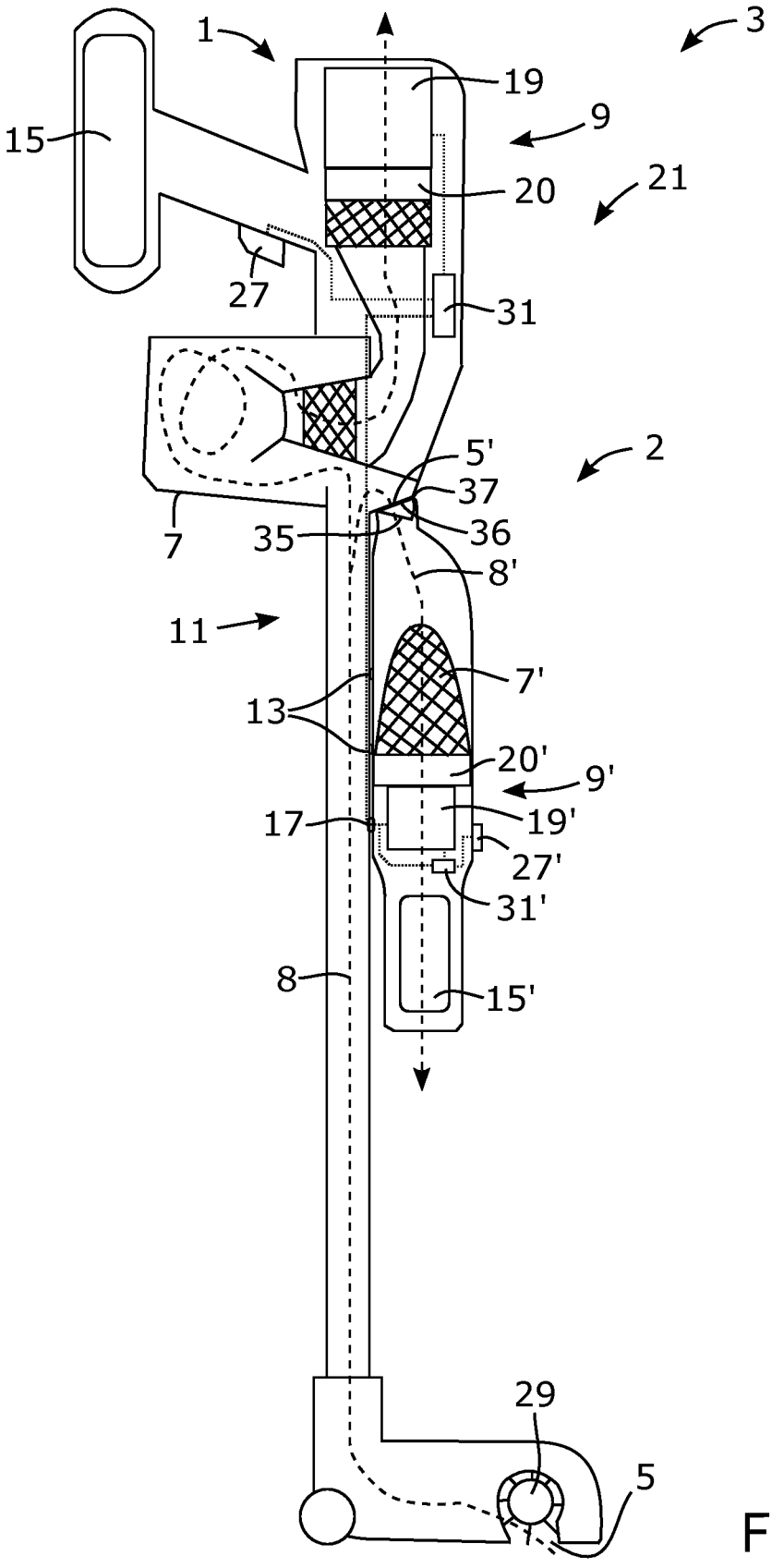
FIG. 1 schematically illustrates a vacuum cleaner apparatus according to some embodiments.

FIG. 1 schematically illustrates a vacuum cleaner apparatus 3 according to some embodiments. The vacuum cleaner apparatus 3 is in some places herein referred to as "the apparatus 3" for reasons of brevity and clarity. The vacuum cleaner apparatus 3 comprises a first vacuum cleaner unit 1 and a second vacuum cleaner unit 2. According to the illustrated embodiments, the second vacuum cleaner unit 2 is smaller in size than the first vacuum cleaner unit 1. In more detail, according to the illustrated embodiments, the first vacuum cleaner unit 1 is a stick-type vacuum cleaner and the second vacuum cleaner unit 2 is a hand-held vacuum cleaner. According to further embodiments of the present disclosure, the first vacuum cleaner unit 1 may be another type of vacuum cleaner, such as a hand-held vacuum cleaner, a canister vacuum cleaner, a robotic vacuum cleaner, or a central vacuum cleaner. Likewise, according to further embodiments of the present disclosure, the second vacuum cleaner unit 2 may be another type of vacuum cleaner, such as a stick-type vacuum, a canister vacuum cleaner, a robotic vacuum cleaner, or a central vacuum cleaner. In embodiments the type of the first and second vacuum cleaner can be mixed. As understood from the herein described, the first vacuum cleaner unit 1 and the second vacuum cleaner unit 2 are together referred to as a vacuum cleaner apparatus 3. This is because of the fact that the vacuum cleaner apparatus 3 can be used in a cooperative cleaning mode in which the first and second vacuum cleaner units 1, 2 cooperates, as is further explained herein. The vacuum cleaner apparatus 3 may also be referred to as a vacuum cleaner system 3. Therefore, throughout this disclosure, the wording "vacuum cleaner apparatus 3" may be replaced by the wording "vacuum cleaner system 3".

The apparatus 3 comprises a first motor/fan unit 9 and a first dust separation unit 7. Each of the first motor/fan unit 9 and the first dust separation unit 7 is arranged in the first vacuum cleaner unit 1. The first motor/fan unit 9 is configured to generate an airflow from a suction inlet 5 of the first vacuum cleaner unit 1 through an airflow path 8 of the first vacuum cleaner unit 1 to the first dust separation unit 7. The first dust separation unit 7 is configured to separate dust from air flowing through the first dust separation unit 7. According to the illustrated embodiments, the first dust separation unit 7 comprises a cyclone separator. According further embodiments, the first dust separation unit 7 may comprise another type of component for separating dust, such as a filter, a dust bag, or the like.

The apparatus 3 comprises a second motor/fan unit 9' and a second dust separation unit 7'. Each of the second motor/fan unit 9' and the second dust separation unit 7' is arranged in the second vacuum cleaner unit 2. The first and second motor/fan units 9, 9' each comprises a fan 20, 20' and an electric motor 19, 19' configured to power/rotate the fan 20, 20'. Each of the fans 20, 20' may comprise a centrifugal fan. The second motor/fan unit 9' is configured to generate an airflow from a suction inlet 5' of the second vacuum cleaner unit 2 to the second dust separation unit 7' via an airflow path 8' of the second vacuum cleaner unit 2. According to the illustrated embodiments, the second dust separation unit 7' comprises a filter. According further embodiments, the second dust separation unit 7' may comprise another type of component for separating dust, such as a cyclone separator, a dust bag, or the like.

As understood from the above, the suction inlet 5, the first motor/fan unit 9, the first dust separation unit 7, and the airflow path 8 is comprised in the first vacuum cleaner unit 1. The suction inlet 5 and the airflow path 8 of the first vacuum cleaner unit 1 may also be referred to as a first suction inlet 5 and a first airflow path 8 of the vacuum cleaner apparatus 3. Likewise, the suction inlet 5', the second motor/fan unit 9', the second dust separation unit 7', and the airflow path 8' is comprised in the second vacuum cleaner unit 2. The suction inlet 5' and the airflow path 8' of the second vacuum cleaner unit 2 may also be referred to as a second suction inlet 5' and a second airflow path 8' of the vacuum cleaner apparatus 3.

The apparatus 3 comprises a connection interface 11. The connection interface 11 is configured to removably connect the suction inlet 5' of the second vacuum cleaner unit 2 to the airflow path 8 of the first vacuum cleaner unit 1. In FIG. 1, the vacuum cleaner apparatus 3 is illustrated in a connected state in which the suction inlet 5' of the second vacuum cleaner unit 2 is connected to the airflow path 8 of the first vacuum cleaner unit 1. Moreover, as is further explained herein, the apparatus 3 comprises a control arrangement 21 (also referred to herein as a "controller" or "at least one controller") capable of operating the apparatus 3 in a cooperative cleaning mode in which the first and second motor/fan units 9, 9' are operated simultaneously. The connection interface 11 thus allows for an operation in the cooperative cleaning mode in which the motor/fan unit 9 of the vacuum cleaner unit 1 and the motor/fan unit 9' of the second vacuum cleaner unit 2 are operated simultaneously. Thereby, a versatile and flexible vacuum cleaner apparatus 3 is provided having conditions for generating high airflow rates at the suction inlet 5 of the first vacuum cleaner unit 1 in an energy efficient manner, as is further explained herein.

According to the illustrated embodiments, the connection interface 11 comprises a closure member 35 and an aperture 36. According to the illustrated embodiments, the closure member 35 and the aperture 36 are arranged on the first vacuum cleaner unit 1. The aperture 36 is in fluid communication with the airflow path 8 of the first vacuum cleaner unit 1. The closure member 35 is movably arranged between an open position, in which the closure member 35 opens the aperture 36, and a closed position in which the closure member 35 closes the aperture 36. In FIG. 1, the closure member 35 is illustrated in the open position. The suction inlet 5' of the second vacuum cleaner unit 2 is connected to the airflow path 8 of the first vacuum cleaner unit 1 via the aperture 36 when the apparatus 3 is in the connected state as is illustrated in FIG. 1. According to some embodiments, the closure member 35 is configured to assume the open position when the apparatus 3 is in the connected state, i.e. when the suction inlet 5' of the second vacuum cleaner unit 2 is connected to the airflow path 8 of the first vacuum cleaner unit 1 via the aperture 36.

According to some embodiments, the closure member 35 is configured such that the position of the closure member 35 is controlled by the difference in air pressure on either side of the closure member 35. As can be seen in FIG. 1, and as is understood from the above described, the closure member 35 is arranged between the airflow path 8 of the first vacuum cleaner unit 1 and the airflow path 8' of the second vacuum cleaner unit 2 when the apparatus 3 is in the connected state. In more detail, according to these embodiments, the closure member 35 may be configured to assume the open position when the air pressure in the airflow path 8' of the second vacuum cleaner unit 2 is lower than the air pressure in the airflow path 8 of the first vacuum cleaner unit 1. According to these embodiments, the closure member 35 may be spring biased in a direction towards the airflow path 8 of the first vacuum cleaner unit 1. In this manner, the closure member 35 can be displaced to the open position in an automatic manner when operation of the second motor/fan unit 9' causes the air pressure at the airflow path 8' of the second vacuum cleaner unit 2 to become lower than the air pressure at the airflow path 8 of the first vacuum cleaner unit 1.

According to some embodiments, the control arrangement 21 is capable of operating the apparatus 3 in a non-cooperative cleaning mode in which only the first motor/fan unit 9 is operated when the suction inlet 5' is connected to the airflow path 8. Thus, in the above described embodiments, the closure member 35 will assume the closed position when the apparatus 3 is operating in the non-cooperative cleaning mode. This because the operation of the first motor/fan unit 9 in the non-cooperative cleaning mode will cause the air pressure at the airflow path 8 of the first vacuum cleaner unit 1 to become lower than the air pressure at the airflow path 8' of the second vacuum cleaner unit 2. Thereby, a reverse flow of air is avoided through the second vacuum cleaner unit 2 into the airflow path 8 of the first vacuum cleaner unit 1 during operation in the non-cooperative cleaning mode.

In the cooperative cleaning mode, each of the first and second motor/fan units 9, 9' generates a partial vacuum. The partial vacuum generated by the first motor/fan unit 9 is transferred to the suction inlet 5 of the first vacuum cleaner unit 1 via the first dust separation unit 7 and the airflow path 8 of the first vacuum cleaner unit 1. The partial vacuum generated by the second motor/fan unit 9' is transferred to the suction inlet 5 of the first vacuum cleaner unit 1 via the second dust separation unit 7', the airflow path 8' of the second vacuum cleaner unit 2, the aperture 36, and the airflow path 8 of the first vacuum cleaner unit 1. Accordingly, dust entering the suction inlet 5 of the first vacuum cleaner unit 1 is separated by the first dust separation unit 7 as well as by the second dust separation unit 7'. In this manner, the total dust accumulating capability of the apparatus 3 is enlarged.

According to the illustrated embodiments, the connection interface 11 comprises a sealing 37. The sealing 37 is configured to seal an area around the aperture 36 between the airflow path 8 of the first vacuum cleaner unit 1 and the suction inlet 5' of the second vacuum cleaner unit 2 when the suction inlet 5' is connected to the airflow path 8. The sealing 37 may comprise a lip seal or another type of soft sealing.

According to the illustrated embodiments, the connection interface 11 comprises a holding arrangement 13. The holding arrangement 13 is configured to hold the second vacuum cleaner unit 2 relative to the first vacuum cleaner unit 1 when the suction inlet 5' of the second vacuum cleaner unit 2 is connected to the airflow path 8 of the first vacuum cleaner unit 1. The holding arrangement 13 may comprise a mechanical holding arrangement 13, such as a slide-fit arrangement, a snap-fit arrangement, or the like. As an alternative, or in addition, the holding arrangement 13 may comprise a magnetic holding arrangement. Moreover, according to some embodiments, the sealing 37 and/or the aperture 36 may form part of the holding arrangement 13.

According to the illustrated embodiments, the second vacuum cleaner unit 2 is operable as a vacuum cleaner in isolation of the first vacuum cleaner unit 1. Likewise, the first vacuum cleaner unit 1 is operable as a vacuum cleaner in isolation of the second vacuum cleaner unit 2. Therefore, the first vacuum cleaner unit 1 may also be referred to as a first vacuum cleaner 1 and the second vacuum cleaner unit 2 may also be referred to as a second vacuum cleaner 2. According to further embodiments, only the second vacuum cleaner unit 2 is operable as a vacuum cleaner in isolation of the first vacuum cleaner unit 1, as is further explained herein.

Figure 2:
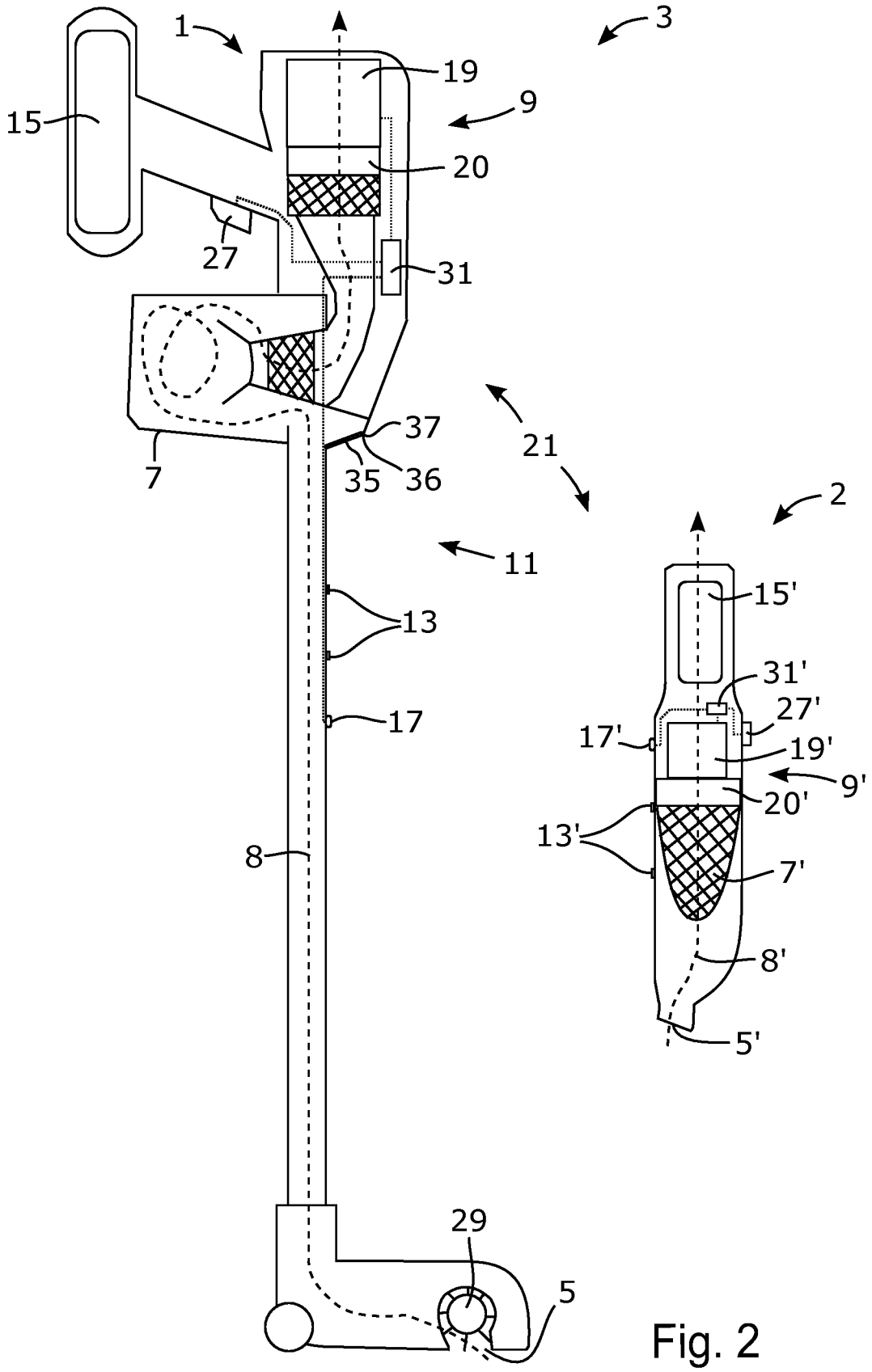
FIG. 2 illustrates the vacuum cleaner apparatus according to the embodiments illustrated in FIG. 1 in a disconnected state.

FIG. 2 illustrates the vacuum cleaner apparatus 3 according to the embodiments illustrated in FIG. 1 in a disconnected state, i.e. in a state in which the suction inlet 5' of the second vacuum cleaner unit 2 is removed from the airflow path 8 of the first vacuum cleaner unit 1. In FIG. 2, the closure member 35 is illustrated in the closed state. As a result, the aperture 36 is closed. According to some embodiments, the closure member 35 is configured to assume the closed position when the suction inlet 5' of the second vacuum cleaner unit 2 is removed from the airflow path 8 of the first vacuum cleaner unit 1. This may be achieved by the closure member 35 being spring biased in a direction towards the airflow path 8 of the first vacuum cleaner unit 1. As an alternative, or in addition, the closure member 35 may be manually operated allowing a user to manually move the closure member 35 between the open and closed positions.

According to the embodiments illustrated in FIG. 1 and FIG. 2, the second vacuum cleaner unit 2 comprises a battery unit 15'. The battery unit 15' is configured to power the second motor/fan unit 9', at least when the suction inlet 5' of the second vacuum cleaner unit 2 is removed from the airflow path 8 of the first vacuum cleaner unit 1, as is illustrated in FIG. 2.

According to the illustrated embodiments, the control arrangement 21 of the vacuum cleaner apparatus 3 comprises a first electronic control unit 31' arranged in the second vacuum cleaner unit 2. The first electronic control unit 31' is configured to control the power of the second motor/fan unit 9' during operation of the second vacuum cleaner unit 2. The second vacuum cleaner unit 2 further comprises an actuator 27' operably connected to the first electronic control unit 31'. The actuator 27' allows a user to activate and deactivate the second motor/fan unit 9'. The actuator 27' may comprise a button, a lever, a switch, or the like. Thus, according to the illustrated embodiments, a user may operate the second vacuum cleaner unit 2 as a vacuum cleaner in isolation of the first vacuum cleaner unit 1 and may activate the second vacuum cleaner unit 2 using the actuator 27'. The second vacuum cleaner unit 2 can thus be utilized for sucking up dust via the suction inlet 5' of the second vacuum cleaner unit 2.

According to the embodiments illustrated in FIG. 1 and FIG. 2, the first vacuum cleaner unit 1 comprises a battery unit 15. The battery unit 15 is configured to power the second motor/fan unit 9, at least when the suction inlet 5' of the second vacuum cleaner unit 2 is removed from the airflow path 8 of the first vacuum cleaner unit 1, as is illustrated in FIG. 2. According to further embodiments of the herein described, the first vacuum cleaner unit 1 may comprise a power cord configured to be inserted into a socket so as to power the second motor/fan unit 9.

According to the illustrated embodiments, the control arrangement 21 comprises a second electronic control unit 31 arranged in the first vacuum cleaner unit 1. According to the illustrated embodiments, the second electronic control unit 31 is configured to control the power of the first motor/fan unit 9 during operation of the first vacuum cleaner unit 1 when the second vacuum cleaner unit 2 is removed from the first vacuum cleaner unit 1. The second electronic control unit 31 may also be referred to as a first electronic control unit 31 since it is arranged in the first vacuum cleaner unit 1. Likewise, the first electronic control unit 31' may also be referred to as a second electronic control unit 31' since it is arranged in the second vacuum cleaner unit 2. However, since the electronic control unit 31' of the second vacuum cleaner unit 2 is mentioned first in the claims of the present disclosure, and due to the fact that the apparatus 3 only comprises the electronic control unit 31' of the second vacuum cleaner unit 2 according to some embodiments of the present disclosure, the electronic control unit 31' of the second vacuum cleaner unit 2 is herein referred to as "the first electronic control unit 31" and the electronic control unit 31 of the first vacuum cleaner unit 1 is herein referred to as "the second electronic control unit 31".

The first vacuum cleaner unit 1 further comprises an actuator 27 operably connected to the second electronic control unit 31. The actuator 27 allows a user to activate and deactivate the first motor/fan unit 9. The actuator 27 may comprise a button, a lever, a switch, or the like. Thus, according to the illustrated embodiments, a user may operate the first vacuum cleaner unit 1 as a vacuum cleaner in isolation of the second vacuum cleaner unit 2 and may activate the first vacuum cleaner unit 1 using the actuator 27. The first vacuum cleaner unit 1 can thus be utilized for sucking up dust via the suction inlet 5 of the first vacuum cleaner unit 1.

According to the illustrated embodiments, the connection interface 11 comprises electrical connections 17, 17' configured operably connect the first and second electronic control units 31, 31' when the apparatus 3 is in the connected state, i.e. when the suction inlet 5' of the second vacuum cleaner unit 2 is connected to the airflow path 8 of the first vacuum cleaner unit 1, as is illustrated in FIG. 1. In the following, simultaneous reference is made to FIG. 1 and FIG. 2.

According to some embodiments, the second electronic control unit 31 is configured to control the power of the first and second motor/fan units 9, 9' when the control arrangement 21 is operating in the cooperative cleaning mode. According to these embodiments, the second electronic control unit 31 may communicate with the first electronic control unit 31' via the electrical connections 17 when the apparatus 3 is in the connected state as is illustrated in FIG. 1. The second electronic control unit 31 may further cause the first electronic control unit 31' to activate the second motor/fan unit 9' upon actuation of the actuator 27 of the first vacuum cleaner unit 1. As an alternative, the second electronic control unit 31 may activate the second motor/fan unit 9' upon actuation of the actuator 27 of the first vacuum cleaner unit 1 without communicating with the first electronic control unit 31'.

According to further embodiments of the present disclosure, the first electronic control unit 31' is configured to control the power of the first and second motor/fan units 9, 9' when the control arrangement 21 is operating in the cooperative cleaning mode. According to these embodiments, the first electronic control unit 31' may communicate with the second electronic control unit 31 via the electrical connections 17 when the apparatus 3 is in the connected state as is illustrated in FIG. 1. The first electronic control unit 31' may further cause the second electronic control unit 31 to activate the first motor/fan unit 9' upon actuation of the actuator 27 of the first vacuum cleaner unit 1.

According to still further embodiments of the present disclosure, the apparatus 3 comprises no second electronic control unit 31 arranged in the first vacuum cleaner unit 1. According to these embodiments, the first electronic control unit 31' arranged in the second vacuum cleaner unit 2 may be configured to control the power of the first motor/fan unit 9 when the vacuum cleaner apparatus 3 is in the connected state and when the control arrangement 21 is operating in the cooperative cleaning mode. Moreover, the first electronic control unit 31' arranged in the second vacuum cleaner unit 2 may be configured to control the power of the first motor/fan unit 9 when the control arrangement 21 is operating in the non-cooperative cleaning mode described herein. Also in these embodiments, the actuator 27 of the first vacuum cleaner unit 1 may be operably connected to the first electronic control unit 31' via the electrical connections 17 allowing the first electronic control unit 31' to control the first and second motor/fan units 9, 9' based on input from the actuator 27 of the first vacuum cleaner unit 1.

Moreover, according to the illustrated embodiments, the electrical connections 17 are configured to transfer electricity between the first and second vacuum cleaner units 1, 2. In more detail, the battery unit 15' of the second vacuum cleaner unit 2 is rechargeable and is configured to be charged using electricity supplied via the electrical connections 17. The battery unit 15' of the second vacuum cleaner unit 2 may be charged using electricity from the battery unit 15 of the first vacuum cleaner unit 1. As an alternative, or in addition, the battery unit 15' of the second vacuum cleaner unit 2 may be charged using electricity supplied via a power cord of the first vacuum cleaner unit 1.

According to the illustrated embodiments, the second motor/fan unit 9' is differently configured than the first motor/fan unit 9. The second motor/fan unit 9' may be differently configured than the first motor/fan unit 9 regarding type and/or size of the electric motor 19' and/or regarding type and/or size of the fan 20'. As an alternative, or in addition, the second motor/fan unit 9' may be differently configured than the first motor/fan unit 9 regarding working point. The working points of the first and second first motor/fan unit 9, 9' may be defined as the airflow rate generated at the highest ratio between suction power and inputted electrical energy. The suction power may be defined as the flowrate times pressure difference generated.

According to the illustrated embodiments, the second motor/fan unit 9' comprises a brushless motor 19' configured to power the fan 20'. Moreover, the first motor/fan unit 9 comprises a brushed motor 19, such as a canister motor, configured to power the fan 20. By combining a brushed motor 19 and a brushless motor 19', a still wider operational range of the apparatus can be provided, as is further explained herein.

According to the embodiments illustrated in FIG. 1 and FIG. 2, the apparatus 3 comprises a brush roll 29 arranged at the suction inlet 5 of the first vacuum cleaner unit 1. The apparatus 3 may comprise an electric motor configured to rotate the brush roll 29. According to such embodiments, one or both of the first and second electronic control units 31, 31' may control operation of the brush roll 29. According to further embodiments, the apparatus 3 may comprise a vacuum motor configured to rotate the brush roll 29 for example using the airflow in the airflow path 8 of the first vacuum cleaner unit 1 to rotate the brush roll 29.

Figure 3:
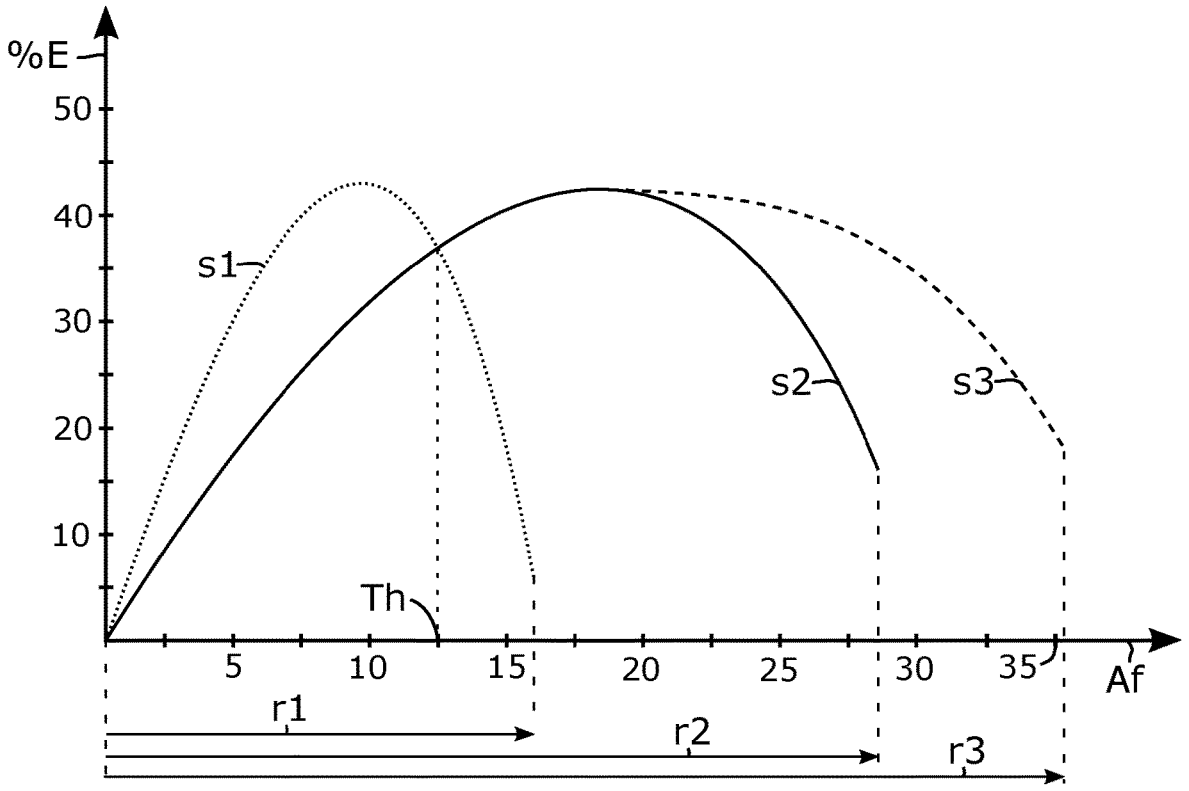
FIG. 3 illustrates a graph showing the correlation between the airflow rate and the energy efficiency of the apparatus according to some embodiments.

FIG. 3 illustrates a graph showing the correlation between the airflow rate Af and the energy efficiency E of the apparatus 3 according to some embodiments explained with reference to FIG. 1 and FIG. 2 when in the connected state. Below, simultaneous reference is made to FIG. 1-FIG. 3. The x-axis of the graph in FIG. 3 shows the airflow rate Af in litres per second at the suction inlet 5 of the first vacuum cleaner unit 1. The y-axis of the graph in FIG. 3 shows the energy efficiency E of the apparatus 3 in percentage. The energy efficiency E of the apparatus 3 is herein defined as the ratio between the useful output in the form of airflow at the suction inlet 5 of the first vacuum cleaner unit 1 and the input of electrical energy.

The dotted line provided with the reference sign s1 indicates the airflow rate Af and energy efficiency E when the apparatus 3 is operating in the non-cooperative mode, i.e. when only the first motor/fan unit 9 is operated and the apparatus 3 is in the connected state. The dotted line provided with the reference sign s1 corresponds to an airflow rate Af and energy efficiency E of a prior art vacuum cleaner comprising one motor/fan unit only.

As can be seen in FIG. 3, the apparatus 3 has a relative high energy efficiency in a lower operational range r1 at approximately 5 and 12.5 litres per second when operating in the non-cooperative mode. However, the apparatus 3 has a relative narrow operational range r1 regarding the possible airflow rate Af.

The full line provided with the reference sign s2 indicates the airflow rate Af and energy efficiency E of an apparatus 3 explained with reference to FIG. 1 and FIG. 2 operating in the cooperative mode, wherein the apparatus 3 comprises a first and second motor/fan unit 9, 9' of identical design.

The dashed line provided with the reference sign s3 indicates the airflow rate Af and energy efficiency E an apparatus 3 explained with reference to FIG. 1 and FIG. 2 operating in the cooperative mode, wherein the apparatus 3 comprises a first and second motor/fan unit 9, 9' having different working points. The different working points of the first and second motor/fan units 9, 9' may be obtained by providing the first and second motor/fan units 9, 9' with different types of motors 19, 19', and or by providing the first and second motor/fan units 9, 9' with different types of fans 20, 20', such as different sizes, different number of blades, different blade angles, and the like.

As can be seen from the full line s2, the apparatus 3 comprising a first and second motor/fan unit 9, 9' of identical design has a significantly higher output capacity and a wider operational range r2 regarding airflow rate Af when operating in the cooperative cleaning mode than a prior art vacuum cleaner comprising one motor/fan unit only. Moreover, the apparatus 3 has a significantly greater energy efficiency E at higher output levels than prior art vacuum cleaner comprising one motor/fan unit only.

Likewise, as can be seen from the dashed line s3, the apparatus 3 comprising a first and second motor/fan unit 9, 9' having different working points has a significantly higher output capacity and a wider operational range r3 regarding airflow rate Af when operating in the cooperative cleaning mode than the apparatus 3 comprising a first and second motor/fan unit 9, 9' of identical design (the full line). Moreover, the apparatus 3 comprising a first and second motor/fan unit 9, 9' having different working points has a greater energy efficiency E at higher output levels than prior art vacuum cleaner comprising one motor/fan unit only. In addition, the apparatus 3 comprising a first and second motor/fan unit 9, 9' having different working points has a significantly greater energy efficiency E at higher output levels, i.e. above approximately 18 litres per second in the illustrated example, than the apparatus 3 comprising a first and second motor/fan unit 9, 9' of identical design (the full line).

According to embodiments herein, the control arrangement 21 may be configured to operate the apparatus 3 in the non-cooperative cleaning mode at lower output ranges and may switch to the cooperative cleaning mode when a wanted output reaches a threshold Th. In this manner, the energy efficiency E of the apparatus 3 can be maximized. In the illustrated example, the threshold Th is set to approximately 12.5 litres per second. This is because in the illustrated example, the apparatus 3 has a greater energy efficiency E at airflow rates below 12.5 litres per second when operating in the non-cooperative cleaning mode whereas the apparatus 3 has a greater energy efficiency E at airflow rates above 12.5 litres per second when operating in the cooperative cleaning mode. Thus, by switching between the non-cooperative cleaning mode and the cooperative cleaning mode based on a wanted output level, the energy efficiency E of the apparatus 3 can be maximized. As understood from the persons skilled in the art, the threshold Th may be set to another value depending on the design of the apparatus 3.

Figure 4:
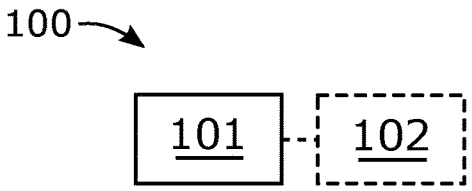
FIG. 4 illustrates a method of operating a vacuum cleaner apparatus according to some embodiments, FIG. 5 schematically illustrates a vacuum cleaner apparatus according to some further embodiments.

FIG. 4 illustrates a method 100 of operating a vacuum cleaner apparatus 3 according to some embodiments. The vacuum cleaner apparatus 3 may be a vacuum cleaner apparatus 3 according to the embodiments illustrated in FIG. 1 and FIG. 2, or a vacuum cleaner apparatus 3 according to the embodiments illustrated in FIG. 5 and FIG. 6, which are further explained below. Therefore, in the following, simultaneous reference is made to FIG. 1, FIG. 2, and FIG. 4-FIG. 6. The vacuum cleaner apparatus 3 comprises a first vacuum cleaner unit 1 and a second vacuum cleaner unit 2. The apparatus 3 comprises a first motor/fan unit 9 and a first dust separation unit 7 arranged in the first vacuum cleaner unit 1. The first motor/fan unit 9 is configured to generate an airflow through an airflow path 8 of the first vacuum cleaner unit 1 to the first dust separation unit 7. The apparatus 3 comprises a second motor/fan unit 9' and a second dust separation unit 7' arranged in the second vacuum cleaner unit 2. The second motor/fan unit 9' is configured to generate an airflow from a suction inlet 5', 5" of the second vacuum cleaner unit 2 to the second dust separation unit 7'. The apparatus 3 comprises a connection interface 11 configured to 30 emovably connect the suction inlet 5', 5" of the second vacuum cleaner unit 2 to the airflow path 8 of the first vacuum cleaner unit 1. As illustrated in FIG. 4, the method 100 comprises the step of:

operating 101 the motor/fan units 9, 9' of the first and second vacuum cleaner units 1, 2 simultaneously.

Moreover, as is illustrated in FIG. 4, the step 101 of operating the motor/fan units 9, 9' of the first and second vacuum cleaner units 1, 2 simultaneously may comprise the step of:

operating 102 the first and second motor/fan units 9, 9' at different power levels.

Thereby, the method 100 provides conditions for significantly widening the operational range in which the vacuum cleaner apparatus 3 can be operated in an efficient manner.

Figure 5:
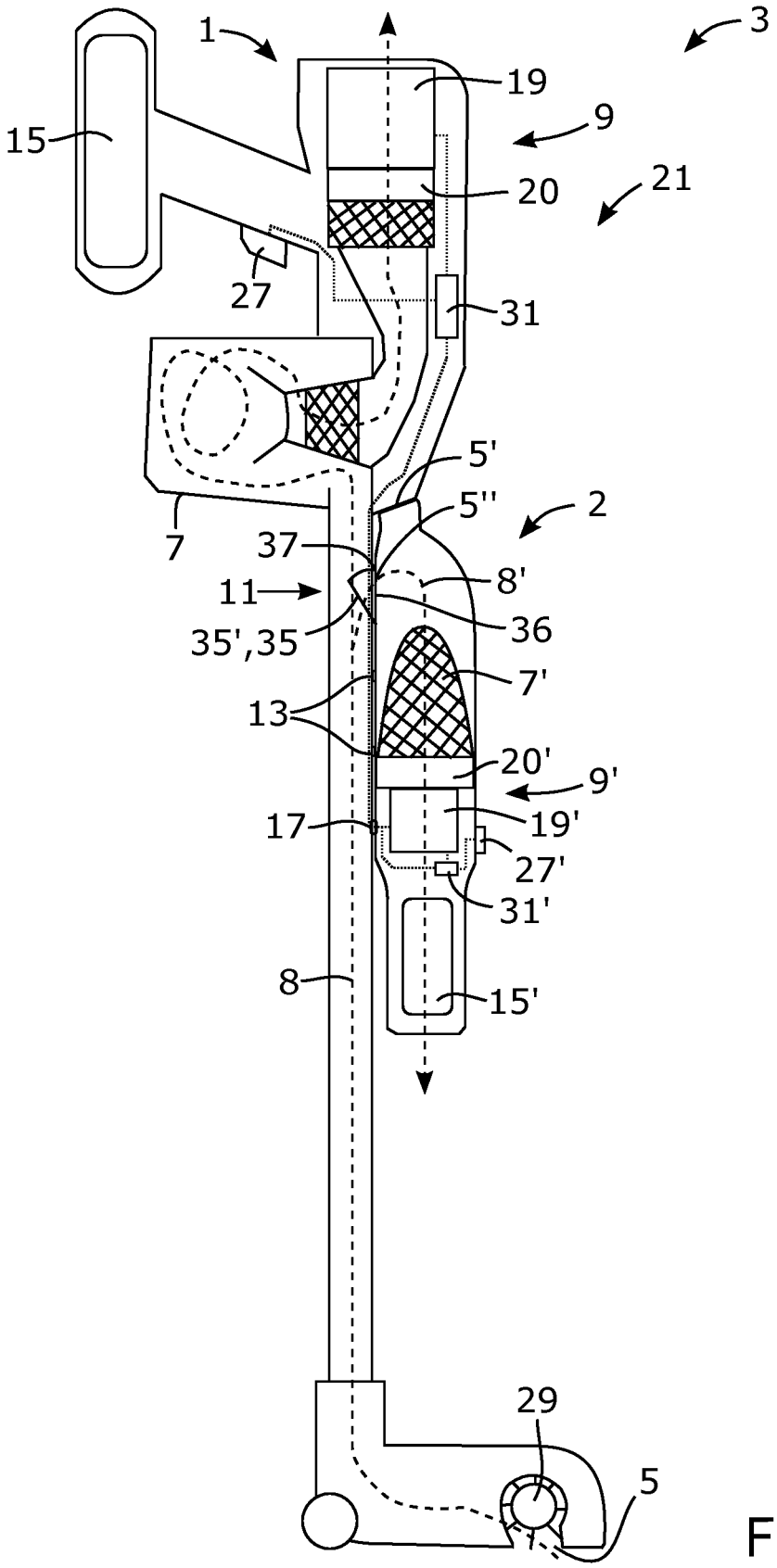

FIG. 5 schematically illustrates a vacuum cleaner apparatus 3 according to some further embodiments. The vacuum cleaner apparatus 3 illustrated in FIG. 5 comprises the same features, functions, and advantages, as the vacuum cleaner apparatus 3 explained with reference to FIG. 1-FIG. 3, with some minor differences explained below.

According to the embodiments illustrated in FIG. 5, the second vacuum cleaner unit 2 of the vacuum cleaner apparatus 3 comprises an auxiliary suction inlet 5" in addition to a main suction inlet 5'. According to these embodiments, the connection interface 11 is configured to removably connect the auxiliary suction inlet 5" of the second vacuum cleaner unit 2 to the airflow path 8 of the first vacuum cleaner unit 1. In FIG. 1, the vacuum cleaner apparatus 3 is illustrated in a connected state in which the auxiliary suction inlet 5" of the second vacuum cleaner unit 2 is connected to the airflow path 8 of the first vacuum cleaner unit 1. According to the illustrated embodiments, the connection interface 11 is configured to block the main suction inlet 5' when the apparatus 3 is in the connected state. According to further embodiments, the apparatus 3 may comprise another type of arrangement for blocking the main suction inlet 5' when the apparatus 3 is in the connected state.

Figure 6:
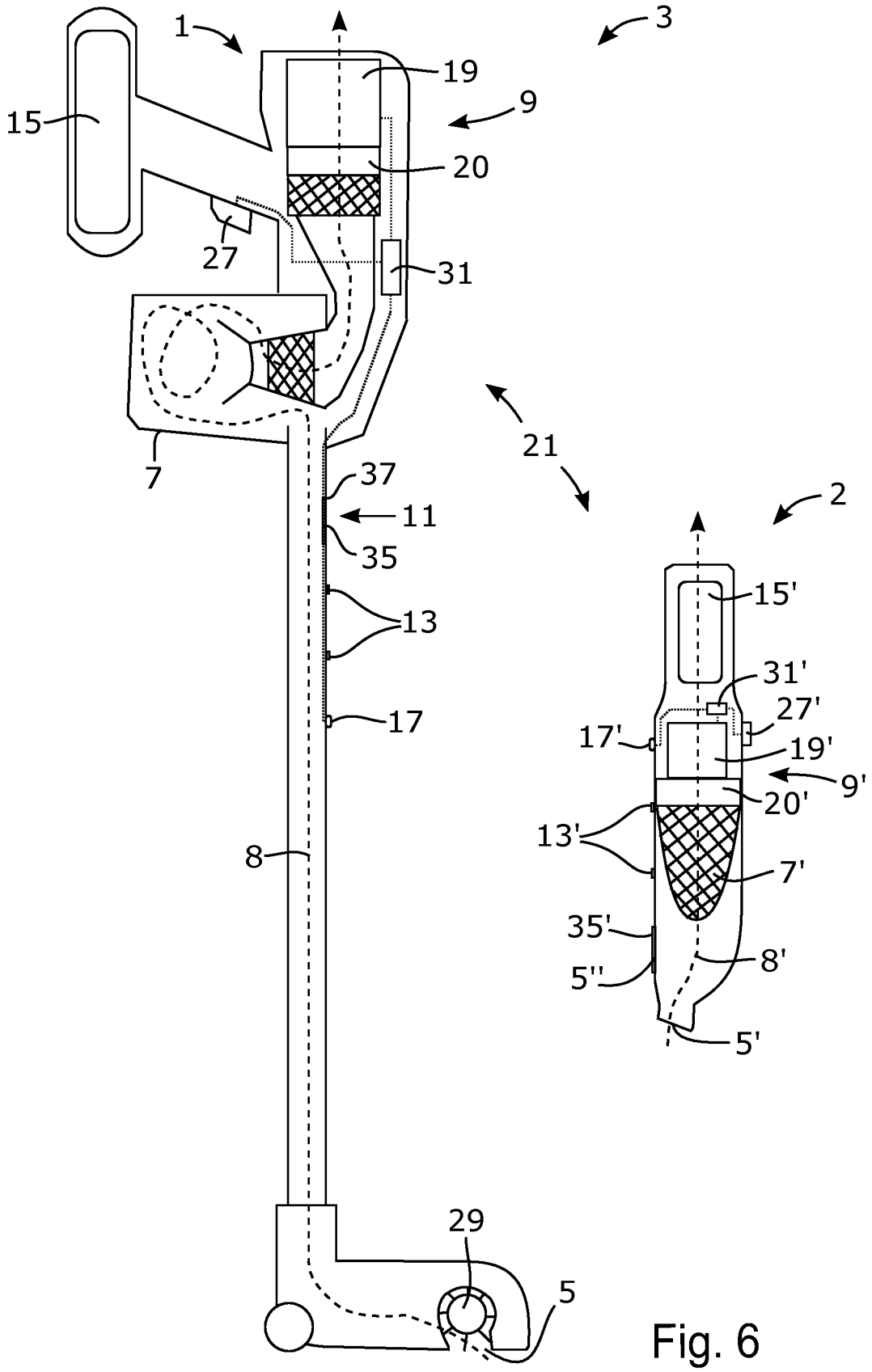
FIG. 6 illustrates the vacuum cleaner apparatus according to the embodiments illustrated in FIG. 5 in a in a disconnected state.

FIG. 6 illustrates the vacuum cleaner apparatus 3 according to the embodiments illustrated in FIG. 5 in a in a disconnected state, i.e. in a state in which the auxiliary suction inlet 5" of the second vacuum cleaner unit 2 is removed from the airflow path 8 of the first vacuum cleaner unit 1. As can be seen in FIG. 6, the second vacuum cleaner unit 2 can be used to suck up dust via the main suction inlet 5' of the second vacuum cleaner unit 2. Moreover, as indicated in FIG. 6, the second vacuum cleaner unit 2 comprises a closure member 35'. The closure member 35' of the second vacuum cleaner unit 2 may also be referred to as a second closure member 35'. The closure member 35' is movably arranged between an open position, in which the closure member 35' opens the auxiliary suction inlet 5", and a closed position, in which closure member 35' closes the auxiliary suction inlet 5". In FIG. 5, the closure member 35' is illustrated in the open position and in FIG. 6 the closure member 35' is illustrated in the closed position. According to some embodiments, the closure member 35' is configured to assume the closed position when the second vacuum cleaner unit 2 is removed from the first vacuum cleaner unit 1. Moreover, the closure member 35' may be configured to assume the open position when the second vacuum cleaner unit 2 is connected to the first vacuum cleaner unit 1. As an alternative, or in addition, the closure member 35' may be manually operated allowing a user to manually move the closure member 35' between the open and closed positions.

The following is explained with simultaneous reference to FIG. 1-FIG. 6. One skilled in the art will appreciate that the method 100 of operating a vacuum cleaner apparatus 3 may be implemented by programmed instructions. These programmed instructions are typically constituted by a computer program, which, when it is executed in the control arrangement 21, ensures that the control arrangement 21 carries out the desired control, such as the method steps 101 and 102 described herein. The computer program is usually part of a computer program product which comprises a suitable digital storage medium on which the computer program is stored.

One or more of the control arrangement 21, the first electronic control unit 31' and the second electronic control unit 31 may comprise a calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above.

One or more of the control arrangement 21, the first electronic control unit 31' and the second electronic control unit 31 may further comprise a memory unit, wherein the calculation unit may be connected to the memory unit, which may provide the calculation unit with, for example, stored program code and/or stored data which the calculation unit may need to enable it to do calculations. The calculation unit may also be adapted to store partial or final results of calculations in the memory unit. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc. in different embodiments.

One or more of the control arrangement 21, the first electronic control unit 31' and the second electronic control unit 31 may be connected to components of the vacuum cleaner apparatus 3 for receiving and/or sending input and output signals. These input and output signals may comprise waveforms, pulses, or other attributes which the input signal receiving devices can detect as information and which can be converted to signals processable by the control arrangement 21, the first electronic control unit 31' and/or the second electronic control unit 31. These signals may then be supplied to a calculation unit of the vacuum cleaner apparatus 3. Each of the connections to the respective components of the vacuum cleaner apparatus 3 for receiving and sending input and output signals may take the form of a cable.

In the embodiments illustrated, the control arrangement 21 of the vacuum cleaner apparatus 3 comprises two electronic control units 31, 31' but might alternatively be implemented wholly or partly in three or more control units, or in one control unit as is explained herein.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

As used herein, the term "comprising" or "comprises" is open-ended, and includes one or more stated features, elements, steps, components, or functions but does not preclude the presence or addition of one or more other features, elements, steps, components, functions, or groups thereof.

The invention claimed is:

1. A vacuum cleaner apparatus comprising:

a first vacuum cleaner unit comprising:

a first dust separation unit, and a first motor/fan unit configured to generate an airflow through an airflow path of the first vacuum cleaner unit to the first dust separation unit;

a second vacuum cleaner unit comprising:

a second dust separation unit, and a second motor/fan unit configured to generate an airflow from a suction inlet of the second vacuum cleaner unit to the second dust separation unit;

a holding arrangement configured to hold the second vacuum cleaner unit relative to the first vacuum cleaner unit when the suction inlet of the second vacuum cleaner unit is connected to the airflow path of the first vacuum cleaner unit, the holding arrangement comprising an aperture between the suction inlet of the second vacuum cleaner unit and the airflow path of the first vacuum cleaner unit when the suction inlet of the second vacuum cleaner unit is connected to the airflow path of the first vacuum cleaner unit;

a closure member connected to the first vacuum cleaner unit and movably arranged between an open position in which the closure member opens the aperture and a closed position in which the closure member closes the aperture; and at least one controller configured to operate in a cooperative cleaning mode in which the at least one controller simultaneously operates the first motor/fan unit and the second motor/fan unit, wherein the suction inlet of the second vacuum cleaner unit is disposed above the second dust separation unit when the second vacuum cleaner unit is connected to the first vacuum cleaner unit and the first vacuum cleaner is in an upright position.

2. The vacuum cleaner apparatus according to claim 1, wherein the at least one controller comprises a first unit controller in the first vacuum cleaner, wherein the first unit controller is configured to operate the first motor/fan unit when the second vacuum cleaner unit is disconnected from the first vacuum cleaner unit.

3. The vacuum cleaner apparatus according to claim 2, wherein the first unit controller is configured to control the operation of the first motor/fan unit and the second motor/fan unit when the at least one controller is operating in the cooperative cleaning mode.

4. The vacuum cleaner apparatus according to claim 1, wherein the second vacuum cleaner unit comprises a second unit battery, and the at least one controller comprises a second unit controller in the second vacuum unit, wherein the second unit controller is configured to operate the second unit battery to drive the second motor/fan unit when the second vacuum cleaner unit is disconnected from the first vacuum cleaner unit.

5. The vacuum cleaner apparatus according to claim 4, wherein the second unit controller is configured to control the first motor/fan unit and the second motor/fan unit when the at least one controller is operating in the cooperative cleaning mode.

6. The vacuum cleaner apparatus according to claim 1, further comprising electrical connections configured operably connect the first unit controller and the second unit controller, and wherein:

the at least one controller comprises a first unit controller in the first vacuum cleaner, wherein the first unit controller is configured to operate the first motor/fan unit when the second vacuum cleaner unit is disconnected from the first vacuum cleaner unit;

the second vacuum cleaner unit comprises a second unit battery; and the at least one controller further comprises a second unit controller in the second vacuum unit, wherein the second unit controller is configured to operate the second unit battery to drive the second motor/fan unit when the second vacuum cleaner unit is disconnected from the first vacuum cleaner unit.

7. The vacuum cleaner apparatus according to claim 1, further comprising electrical connections configured to transfer electricity between the first vacuum cleaner unit and the second vacuum cleaner unit.

8. The vacuum cleaner apparatus according to claim 7, further comprising electrical connections, and wherein the second vacuum cleaner unit comprises a second unit battery, and the electrical connections configured to transfer electricity from the first vacuum cleaner unit to the second vacuum cleaner unit to charge the second unit battery.

9. The vacuum cleaner apparatus according to claim 1, wherein the second motor/fan unit comprises:

a second unit fan; and a brushless motor configured to drive the second unit fan.

10. The vacuum cleaner apparatus according to claim 9, wherein the first motor/fan unit comprises:

a first unit fan; and a brushed motor configured to drive the first unit fan.

11. The vacuum cleaner apparatus according to claim 1, wherein the second vacuum cleaner unit is smaller in size than the first vacuum cleaner unit.

12. The vacuum cleaner apparatus according to claim 1, wherein the closure member is configured to assume the open position when the air pressure in the airflow path of the second vacuum cleaner unit is lower than the air pressure in the airflow path of the first vacuum cleaner unit.

13. The vacuum cleaner apparatus according to claim 1, wherein the closure member is spring biased in a direction towards the airflow path of the first vacuum cleaner unit.

14. The vacuum cleaner apparatus according to claim 1, wherein the closure member is configured to assume the closed position when the second vacuum cleaner unit is disconnected from the first vacuum cleaner unit.

15. The vacuum cleaner apparatus according to claim 1, wherein the holding arrangement comprises a seal configured to seal an area around the aperture between the suction inlet of the second vacuum cleaner unit and the airflow path of the first vacuum cleaner unit when the second vacuum cleaner unit is connected to the first vacuum cleaner unit.

16. The vacuum cleaner apparatus according to claim 1, wherein the at least one controller is configured to operate in a non-cooperative cleaning mode in which the at least one controller operates the first motor/fan unit and not the second motor/fan unit when the second vacuum cleaner unit is connected to the first vacuum cleaner unit.

17. The vacuum cleaner apparatus according to claim 16, wherein:

the closure member is configured to assume the closed position when the at least one controller is operating in the non-cooperative cleaning mode.

18. The vacuum cleaner apparatus according to claim 1, wherein:

the second vacuum cleaner unit is a hand-held vacuum cleaner; and the first vacuum cleaner unit is a stick-type vacuum cleaner having a handle, an elongated airflow path, and an inlet nozzle having a brushroll therein.

19. A method of operating a vacuum cleaner apparatus comprising:

a first vacuum cleaner unit having a first motor/fan unit and a first dust separation unit arranged in the first vacuum cleaner unit, wherein the first motor/fan unit is configured to generate an airflow through an airflow path of the first vacuum cleaner unit to the first dust separation unit;

a second vacuum cleaner unit having a second motor/fan unit and a second dust separation unit arranged in the second vacuum cleaner unit, and wherein the second motor/fan unit is configured to generate an airflow from a suction inlet of the second vacuum cleaner unit to the second dust separation unit;

a holding arrangement configured to hold the second vacuum cleaner unit relative to the first vacuum cleaner unit when the suction inlet of the second vacuum cleaner unit is connected to the airflow path of the first vacuum cleaner unit, the holding arrangement comprising an aperture between the suction inlet of the second vacuum cleaner unit and the airflow path of the first vacuum cleaner unit when the suction inlet of the second vacuum cleaner unit is connected to the airflow path of the first vacuum cleaner unit; and a closure member connected to the first vacuum cleaner unit and movably arranged between an open position in which the closure member opens the aperture and a closed position in which the closure member closes the aperture, wherein the suction inlet of the second vacuum cleaner unit is disposed above the second dust separation unit when the second vacuum cleaner unit is connected to the first vacuum cleaner unit and the first vacuum cleaner is in an upright position, and wherein the method comprises:

operating the first motor/fan unit and the second motor/fan unit simultaneously in a cooperative cleaning mode.

20. The method according to claim 19, wherein operating the first motor/fan unit and the second motor/fan unit simultaneously in a cooperative cleaning mode comprises operating the first fan/motor unit and the second motor/fan units at different power levels.

21. The method according to claim 19, further comprising:

operating the first motor/fan unit while not operating the second motor/fan unit simultaneously in a non-cooperative cleaning mode.

* * * * *